US006214170B1

(12) United States Patent
Begemann et al.

(10) Patent No.: US 6,214,170 B1
(45) Date of Patent: Apr. 10, 2001

(54) PROCESS FOR CLEANING OR MAINTAINING THE CLEANLINESS OF THE LOW-CONSISTENCY BRANCH OF A HEADBOX SYSTEM

(75) Inventors: Ulrich Begemann, Heidenheim; Holger Humberg, Nattheim, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/401,953

(22) Filed: Sep. 23, 1999

(30) Foreign Application Priority Data

Sep. 24, 1998 (DE) ..... 198 43 728

(51) Int. Cl.[7] ..... D21F 1/00

(52) U.S. Cl. ..... 162/216; 162/336; 162/190; 162/264; 162/322; 162/343

(58) Field of Search ..... 162/216, 336, 162/190, 264, 322, 343

(56) References Cited

U.S. PATENT DOCUMENTS

| | | | |
|---|---|---|---|
| 5,707,495 | 1/1998 | Heinzmann et al. . | |
| 5,709,777 | 1/1998 | Gegemann et al. . | |
| 5,958,189 * | 9/1999 | Begemann et al. | 162/264 |

FOREIGN PATENT DOCUMENTS

| | | |
|---|---|---|
| 3741603 | 6/1989 | (DE) . |
| 4019593 | 1/1992 | (DE) . |
| 4211291 | 10/1993 | (DE) . |
| 4323263 | 1/1994 | (DE) . |
| 4410556 | 8/1994 | (DE) . |
| 4422907 | 1/1996 | (DE) . |
| 4239845 | 12/1998 | (DE) . |
| 565923 | 2/1996 | (EP) . |
| 733735 | 9/1996 | (EP) . |
| 98/24973 | 6/1998 | (WO) . |

OTHER PUBLICATIONS

Ulrich Begemann, "Stoffdichtequerprofilregelung: Voraussetzungen für eine erfolgreiche Installation". *Das Papier 6,* pp. 344–348 (1998).

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Process for cleaning or maintaining the cleanliness of a low-consistency branch of a stock density-regulated headbox system including a constant part of a paper or cardboard machine having at least one high-consistency branch and one low-consistency branch, possibly sectioned. The final concentration output by the headbox onto a wire or between two wires is determined by a mixing ratio of high-concentration and low-concentration suspension flows. The process includes supplying the low-consistency branch with an increased content of solid particles. Headbox system including a constant part of a paper or cardboard machine, having a stock density regulation that is sectioned across the machine width by variably mixing a high-consistency suspension and a low-consistency suspension, with a high-consistency branch and a low-consistency branch. The headbox system includes at least one supply to the low-consistency branch for introducing solid particle contents into the suspension flow.

20 Claims, 1 Drawing Sheet

PROCESS FOR CLEANING OR MAINTAINING THE CLEANLINESS OF THE LOW-CONSISTENCY BRANCH OF A HEADBOX SYSTEM

CROSS-REFERENCE TO RELATED APPLICATIONS

The present application claims priority under 35 U.S.C. § 119 of German Patent Application No. 198 43 728.5, filed on Sep. 24, 1998, the disclosure of which is expressly incorporated by reference herein in its entirety.

BACKGROUND OF THE INVENTION

1. Field of the Invention

The invention relates to a process for cleaning or maintaining the cleanliness of a low-consistency branch of a stock density-regulated headbox system including the constant part of a paper or cardboard machine with at least one high-consistency branch and a low-consistency branch, where the final concentration output by the headbox onto a wire or between two wires is determined by the mixing ratio of high-concentration and low-concentration suspension flows.

The invention further relates to a headbox system including the constant part of a paper or cardboard machine with a stock density regulation that is sectioned across the machine width by variably mixing a high-consistency suspension and a low-consistency suspension, having a high-consistency branch and a low-consistency branch.

2. Discussion of Background Information

Sectional stock density-regulated headbox systems are generally known from countless patent applications and disclosures. For example, reference is made to Applicant's German Patent Disclosure Document DE 40 19 593 A1, which discloses a sectional stock density-regulated headbox with two branches of individual supplies that are distributed across the machine width and are for two stock suspensions that have different concentrations. In this instance, paper stock and backwater are used as the suspensions with the different consistencies. With variances in the basis weight cross section of the paper web at a particular point of the web width, which is associated with a particular section of the headbox, the concentration $C_M$ of the relevant section flow is corrected by changing the quantity ratio of regulating flows that are supplied to a mixer and have different solids contents $Q_H/Q_L$. This type of basis weight cross section regulation is very advantageous with regard to a simultaneously good fiber orientation cross section and causes very favorable results with regard to the basis weight cross section.

The disclosure of this previously cited reference and Applicant's earlier Patent Applications DE 37 41 603 A1, DE 44 22 907 A1, DE 42 37 304 A1, and DE 42 11 291 A1, particularly with regard to the possibilities for density regulation of the final concentration of stock suspensions by mixing suspensions that have different concentrations, are herein incorporated by reference in their entireties. In particular with regard to the cited prior art, it should be emphasized that possible basis weight changes that are produced by metering particular fibrous materials or fibrous material contents can be compensated for in the known headboxes by means of a corresponding regulation mechanism that influences the sectional concentration of the stock suspension. The cited prior art discloses in detail how the supply to the headbox of stock suspensions that have different properties can be carried out and how the basis weight cross section of the material web can be kept uniform.

In practice, with the above-cited stock density-regulated headbox systems, the desired final concentration is usually regulated by means of a more or less intensive admixing of backwater I or clear filtrate to a slightly over-concentrated stock suspension, where backwater I is understood to mean all of the circulating backwater. In this connection, it has turned out that increased scale and slime deposits can occur in the supply lines of the low concentrate. As a result of this, on the one hand, the regulation mechanisms can be impaired, because the hydraulic resistances of the lines change; on the other hand, there is also the danger of quality losses due to the sudden freeing of such scale and/or slime deposits. At present, if scale or slime deposits of this sort occur, the attempt is made either to clean the scale and/or slime deposits during operation with the aid of expensive chemical additives or additives that impair the manufacturing process or to carry out a mechanical cleaning when the machine is shut down.

SUMMARY OF THE INVENTION

Other exemplary embodiments and advantages of the present invention may be ascertained by reviewing the present disclosure and the accompanying drawing.

An object of the invention is to provide a different process for cleaning or maintaining the cleanliness of the low-consistency branch of a stock density-regulated headbox system including the constant part of a paper or cardboard machine which can also be carried out during operation without side effects interfering with the production. A further object is to provide a headbox system that is suitable for performing this process.

The inventors have recognized that the scale and/or slime deposits on the walls of lines and devices in the vicinity of low-consistency suspension paths essentially occur because, in contrast to the high-consistency suspensions, few solids are entrained. As a result of this, when left undisturbed, a relatively thick boundary layer accumulates on the walls at low flow speeds, as a result of which, the adhesion and cohesion forces become greater than the flow-induced shear forces and scale and/or slime deposits occur.

In order to prevent the process explained above, a process is provided for cleaning or maintaining the cleanliness of the low-consistency branch of a stock density-regulated headbox of a paper or cardboard machine. The headbox has at least one high-consistency branch and one low-consistency branch. The final concentration output by the headbox onto a wire or between two wires is determined by the mixing ratio of high-concentration and low-concentration suspension flows to the effect that an increased content of solid particles is supplied to the low-consistency branch. Due to interferences, the supply of solid particles produces a reduction of the boundary layer thickness and thus an increase in the shear forces in the wall region. As a result of this measure, a cleaning effect is produced which breaks down existing scale and/or slime deposits or assures that the formation of scale and slime deposits is hindered or prevented.

A process is provided for cleaning or maintaining the cleanliness of the low-consistency branch of a stock density-regulated headbox system comprising a constant part of a paper or cardboard machine having at least one high-consistency branch and one low-consistency branch, possibly sectioned. The process includes mixing a ratio of high-concentration and low-concentration suspension flows to determine a final concentration output by the headbox onto a wire or between two wires; and supplying the low-consistency branch with an increased content of solid particles.

According to another advantageous embodiment of the process provides that, at the same time as the increase of the solid content in the low-consistency branch, the corresponding solid particle content in the high-consistency branch is reduced or that, in a particularly advantageous manner, the sum of the supplied solid particle contents in the low-consistency branch is equal to the sum of the reduced solid particle contents of the high-consistency branch. By means of this, the process can be used for continuous production without disadvantage because no greater interference with the basis weight occurs.

It is particularly advantageous if the mass of the supplied solid particle content of one section in the low-consistency branch is equal to the reduced mass in this section of the solid particle content of the high-consistency branch. This not only maintains the average of the basis weight of the paper or cardboard web produced, but also maintains the basis weight cross section of the web produced.

Is also possible to supply both the low-consistency branch and the high-consistency branch in a controlled fashion, i.e., controlled or regulated, such that, to increase the solid particle content in a section in the low-consistency branch, the quantity distribution between the high-consistency branch and the low-consistency branch in this section is changed.

Another advantageous embodiment according to the invention provides that solid particle contents are supplied in a controlled fashion to both the low-consistency branch and the high-consistency branch, such that, to increase the solid particle content in the low-consistency branch, the quantity distribution between the high-consistency branch and the low-consistency branch is changed. In this connection, the total suspension supply can be supplied with a particular, constant total quantity of solid particles and only for the cleaning is a "re-routing" of the solid particles from the high-consistency branch to the low-consistency branch carried out.

It is particularly advantageous in the execution of the process if fibers, preferably long fibers, are used as the solid particles. In comparison to compact solid particles, the long fibers act as a type of fluid brush and remove the boundary layers particularly well. In this connection, these can, for example, be wood fibers, usually from the continuous stock production, or they can be fibers made of synthetic materials, for example, plastic. Synthetic fibers offer the advantage that they can be manufactured in a very definite manner and, with regard to their properties, do not depend on the variation of a natural product. In general, though, any solid particles that produce a cleaning effect can be used as long as negative influences on the finished product are not produced.

According to the invention, the addition of solid particles into a low-consistency branch can occur continuously in order to intrinsically prevent scale and/or slime deposits. Further, in the production of particularly high-quality papers, the addition can take place intermittently in order, for example, to treat the paper produced in this production period as a lower-quality paper.

In order not to reduce the regulating potentials of the headbox system, the stock density difference between the low-consistency branch and the high-consistency branch should not be significantly reduced through the addition of solid particles. To this end, it is possible to mix the fibrous material or the solid particle-containing stock with clear filtrate or fresh water, to increase the high-consistency stock density, and/or to increase the low-consistency content.

According to the concept of the invention, for the execution of the above-described process, the proposal is also made to further develop a headbox system of a paper or cardboard machine having stock density regulation, which is sectioned across the machine width by variably mixing a high-consistency suspension and a low-consistency suspension, and having a high-consistency branch and a low-consistency branch, to the effect that at least one supply is provided in the low-consistency branch for the introduction of solid particle contents into the suspension flow.

A headbox system according to the invention includes a constant part of a paper or cardboard machine, having a stock density regulation sectioned across a machine width by variably mixing a high-consistency suspension and a low-consistency suspension. The headbox also includes a high-consistency branch and a low-consistency branch. The headbox further includes at least one supply, provided in the low-consistency branch, that introduces solid particle contents into a suspension flow.

An advantageous embodiment provides that the low-consistency branch includes a plurality of sectional individual supply lines and, for each individual supply line, there is a supply for the introduction of solid particle contents.

According to another embodiment, the high-consistency branch is provided with at least one supply for the introduction of solid particle contents and if necessary, to also provide the high-consistency branch with a plurality of sectional individual supply lines, and to provide each individual supply line with a supply for the introduction of solid particle contents.

The headbox system may also include a valve that meters the supplied quantity for each supply that introduces solid particles.

Naturally, the above-mentioned features of the invention and those yet to be explained below can be used not only in the respectively indicated combination but also in other combinations or individually without going beyond the scope of the invention.

BRIEF DESCRIPTION OF THE DRAWINGS

The present invention is further described in the detailed description which follows, with reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
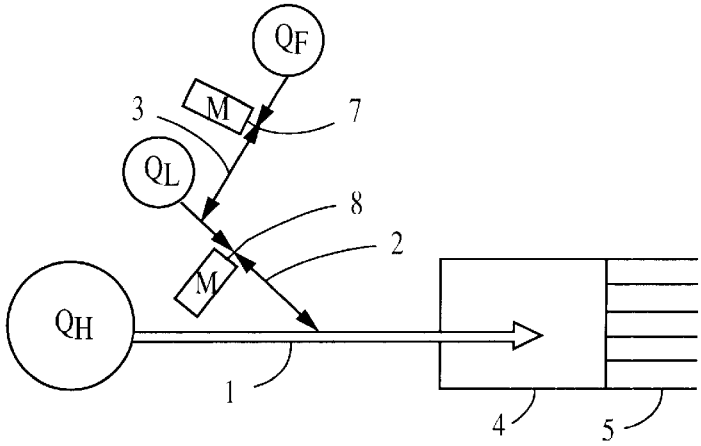
FIG. 1 is a schematic representation of a headbox system according to the invention, having a solid particle supply in the low-consistency branch.
Figure 2:
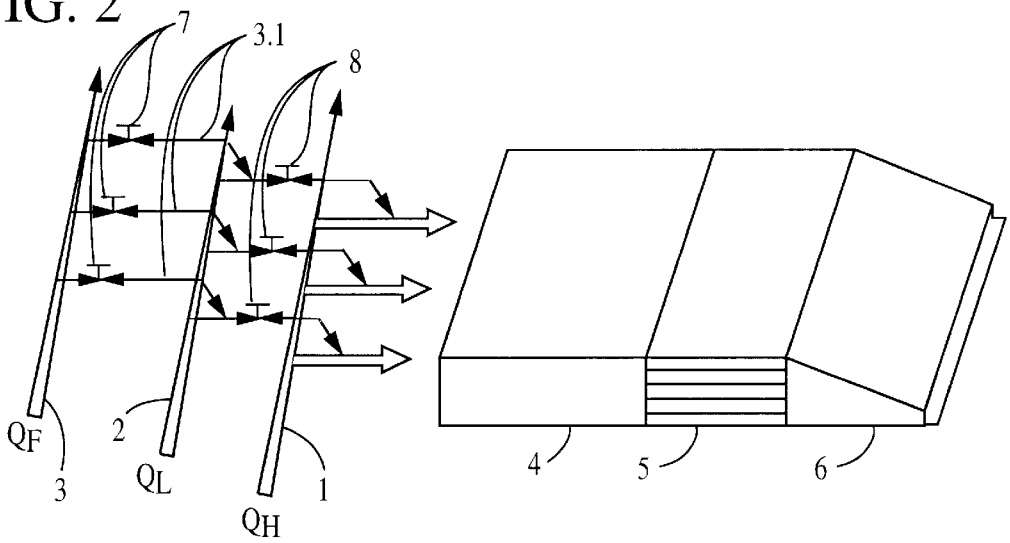
FIG. 2 is a schematic representation of a headbox system according to the invention, having a sectioned high-consistency branch and a sectioned low-consistency branch, with a sectioned solid particle supply in the low-consistency branch.
Figure 3:
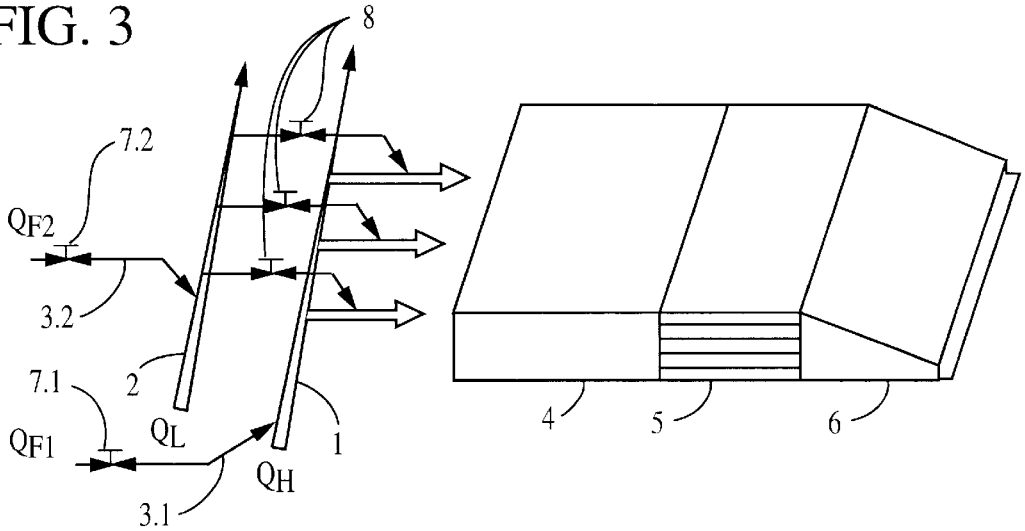
FIG. 3 is a schematic representation of a headbox system according to the invention, having a sectioned high-consistency branch and a sectioned low-consistency branch, and a solid particle supply in the high-consistency branch and the low-consistency branch.

FIGS. 1 to 3 are schematic representations of stock density-regulated headbox systems, according to the invention, having solid particle supply. In these examples, the headboxes are each charged with two stock suspension branches including a high-consistency branch 1, which conveys the high-consistency volume flow $Q_H$, and a low-consistency branch 2, which conveys the low-consistency volume flow $Q_L$, with backwater. In addition, another suspension flow $Q_F$ with the cleanest possible solid particles, preferably fibrous contents, feeds by means of the supply line 3 into the low-consistency branch 2 in accordance with the invention.

FIG. 1 is a schematic longitudinal section through a stock density-regulated headbox system. The stock density regulation takes place by means of a volume flow regulation of the low-consistency volume flow $Q_L$, which is supplied by means of the supply line 3 into the high-consistency branch 1 and is regulated with the aid of a metering valve 8. Changing the mixing ratios exerts influence on the final concentration of the suspension emerging from the headbox. The suspension flow $Q_F$, which carries solid particle contents and is for cleaning the lines, is likewise regulated or controlled with regard to its flow rate by means of a metering valve 7. This makes it possible to meter the solid particle supply in the desired manner, if necessary while maintaining the sum of the volume flows $Q_L+Q_F$ and to carry out the cleaning intermittently or continuously as needed.

FIG. 2 is a schematic side view of the headbox system that is sectioned across the machine width, in which all of the suspension branches—the high-consistency branch 1, the low-consistency branch 2, and supply lines for long fibers/solid particles 3—are embodied sectionally. The three sections shown by way of example here represent a significantly larger number of sections in actual use. The headbox with the headbox nozzle 6, turbulence generator 5, and antechamber 4 is supplied with the sectioned volume flows $Q_H$ and $Q_L$ in the branches 1 and 2, such that the low-consistency volume flow $Q_L$ is sectionally controlled by means of the metering valves 8 and, in this way, the final concentration of the suspension is determined for each section. In addition, the sectioned individual low-consistency volume flows $Q_L$, which are regulated by means of metering valves 7, are each supplied with a volume flow $Q_F$, which intrinsically has a low stock concentration, but has an increased content of long fibers.

FIG. 3 is a schematically represented side view of another embodiment of a headbox system according to the invention, having a headbox with a headbox nozzle 6, a turbulence generator 5, and an antechamber 4 into which the mixture flows comprising high-consistency and low-consistency volume flows $Q_H$ and $Q_L$, are sectionally introduced. In contrast to FIG. 2, two volume flows $Q_{F1}$ and $Q_{F2}$, which can be regulated by means of metering valves 7.1 and 7.2, are introduced by means of the supply lines 3.1 and 3.2 into the high-consistency volume flow $Q_H$ and into the low-consistency volume flow $Q_L$. Through this type of embodiment, the supply ratio of long fiber contents into the two volume flows $Q_H$ and $Q_L$ can be varied arbitrarily, such that the sum of the supply of long fiber contents $Q_F=Q_{F1}+Q_{F2}$ can always be kept constant.

The process according to the invention and the headbox system according to the invention thus make it possible to maintain the cleanliness of or to clean the low-consistency branch of a stock density-regulated headbox system including the constant part of a paper or cardboard machine even during operation without side effects interfering with the production due to the addition of solid particles, in particular long fibers.

It is noted that the foregoing examples have been provided merely for the purpose of explanation and are in no way to be construed as limiting of the present invention. While the present invention has been described with reference to an exemplary embodiment, it is understood that the words that have been used herein are words of description and illustration, rather than words of limitation. Chances may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for cleaning or maintaining the cleanliness of a low-consistency branch of a stock density-regulated headbox system that includes a constant part of a paper or cardboard machine having at least one high-consistency branch and the low-consistency branch, wherein low concentration suspension flows are supplied by the low-consistency branch and the high-concentration suspension flows are supplied by the at least one high-consistency branch, the process comprising:

mixing a ratio of high-concentration and low-concentration suspension flows to determine a final concentration output by the headbox one of onto a wire and between two wires; and supplying the low-consistency branch with an increased content of solid particles to one of clean and maintain a cleanliness of the low-consistency branch.

2. The process according to claim 1, further comprising simultaneously reducing the corresponding solid particle content of the high-consistency branch.

3. The process according to claim 2, wherein the sum of the supplied solid particle contents in the low-consistency branch is equal to the sum of the reduced solid particle contents of the high-consistency branch.

4. The process according to claim 2, wherein the mass of the supplied solid particle content of a section in the low-consistency branch is equal to the reduced mass of the section of the solid particle content of the high-consistency branch.

5. The process according to claim 1, further comprising supplying solid particle contents in a controlled manner to both the low-consistency branch and the high-consistency branch, wherein an increased solid particle proportion in the low-consistency branch changes the quantity distribution between the high-consistency branch and the low-consistency branch.

6. The process according to one of claim 1, further comprising supplying solid particle contents in a controlled manner to both the low-consistency branch and the high-consistency branch, wherein an increased solid particle content in a section in the low-consistency branch changes the quantity distribution between the high-consistency branch and the low-consistency branch in the section.

7. The process according to claim 1, in which the solid particles comprise long fibers.

8. The process according to claim 7, in which the fibers comprise wood fibers.

9. The process according to claim 7, in which the fibers comprise fibers made of plastic.

10. The process according to claim 1, in which the solid particles comprise particles to remove undesired deposits.

11. The process according to claim 1, wherein the supplying of solid particles into the low-consistency branch occurs continuously.

12. The process according to claim 1, wherein the supplying of solid particles into the low-consistency branch occurs intermittently.

13. The process according to claim 1, wherein the increased content of solid particles is supplied to remove undesired deposits in the low-consistency branch.

14. The process according to claim 1, wherein the supply of the solid particles to the low-consistency branch does not affect the final concentration output by the headbox.

15. The process according to claim 1, wherein the supply of the solid particles to the low-consistency branch does not interfere with the basis weight.

16. The process according to claim 1, wherein the supply of the solid particles to the low-consistency branch reduces a boundary layer thickness to break down at least one of slime and scale deposits in the low-consistency branch.

17. The process according to claim 1, wherein the supply of the solid particles to the low-consistency branch increases shear forces in a wall region of the low-consistency branch to break down at least one of slime and scale deposits in the low-consistency branch.

18. The process according to claim 10, wherein the undesired deposits comprise at least one of slime and scale deposits.

19. A process for cleaning or maintaining the cleanliness of a low-consistency branch of a stock density-regulated headbox system that includes a constant part of a paper or cardboard machine having at least one high-consistency branch and the low-consistency branch, the process comprising:

mixing a ratio of flows from the at least one high-consistency branch and the low-consistency branch to achieve an output of the headbox to be deposited one of onto a wire and between two wires; and supplying the low-consistency branch with an increased content of solid particles to one of clean and maintain the cleanliness of the low-consistency branch.

20. The process according to claim 19, wherein the low-consistency branch is one of cleaned and maintained during operation of the stock density-regulated headbox.

* * * * *